US007033292B2

(12) United States Patent
Kennedy, III et al.

(10) Patent No.: US 7,033,292 B2
(45) **Date of Patent: *Apr. 25, 2006**

(54) SPORT BALL WITH SELF-CONTAINED INFLATION MECHANISM HAVING PRESSURE INDICATION

(75) Inventors: Thomas J. Kennedy, III, Wilbraham, MA (US); Ronald P. Laliberty, Dudley, MA (US); Ken Schomburg, Wayzata, MN (US)

(73) Assignee: Russell Asset Management, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/645,309

(22) Filed: Aug. 21, 2003

(65) Prior Publication Data

US 2004/0110582 A1 Jun. 10, 2004

Related U.S. Application Data

(60) Provisional application No. 60/404,889, filed on Aug. 21, 2002.

(51) Int. Cl.
*A63B 41/12* (2006.01)

(52) U.S. Cl. ..... 473/593

(58) Field of Classification Search ..... 473/593–595, 473/603–611; 446/220, 224; 417/478, 480, 417/499, 259; 36/29
See application file for complete search history.

(56) References Cited

U.S. PATENT DOCUMENTS

| | | | |
|---|---|---|---|
| 362,532 | A | 5/1887 | Patterson |
| 602,294 | A | 4/1898 | Arnold |
| 2,625,770 | A | 1/1953 | Steen |
| 2,698,028 | A | 12/1954 | Lee |
| 2,737,969 | A | 3/1956 | Iknayan |
| 3,020,673 | A | 6/1962 | Cook |
| 3,119,617 | A | 1/1964 | Topper |
| 3,229,978 | A | 1/1966 | Allen |
| 3,230,968 | A | 1/1966 | Struby |
| 4,568,081 | A | 2/1986 | Martin |
| 4,595,200 | A | 6/1986 | Shishido |
| 4,776,589 | A | 10/1988 | Yang |
| 4,842,563 | A | 6/1989 | Russell |
| 4,858,781 | A | 8/1989 | Shishido |
| 4,862,533 | A | 9/1989 | Adams, III |
| 5,068,933 | A | 12/1991 | Sexton |
| 5,098,085 | A | 3/1992 | Weiss |
| 5,219,162 | A | 6/1993 | Orbanes |
| 5,238,244 | A | 8/1993 | Cotter |
| 5,375,839 | A | 12/1994 | Pagani |
| 5,500,965 | A | 3/1996 | Hannagan |
| 5,603,131 | A | 2/1997 | DeJean, Jr. |
| 5,755,634 | A | 5/1998 | Huang |
| 6,287,225 | B1 | 9/2001 | Touhey |
| 6,409,618 | B1 | 6/2002 | Touhey |
| 6,422,960 | B1 | 7/2002 | Touhey |
| 6,450,906 | B1 | 9/2002 | Touhey |
| 6,491,595 | B1 | 12/2002 | Feeney |
| 6,702,699 | B1 | 3/2004 | Touhey |

FOREIGN PATENT DOCUMENTS

| | | | |
|---|---|---|---|
| GB | 2 353 864 | A | 7/2001 |

*Primary Examiner*—Steven Wong

(57) ABSTRACT

An inflatable sport ball, such as a basketball, a football, a soccer ball, a volleyball or a playground ball, is provided with a self-contained inflation mechanism, or multiple self-contained inflation mechanisms, for inflating or more likely adding pressure to the ball. The mechanism is a pump which is inside of the ball and which is operable from outside of the ball to pump ambient air into the ball. The pump contains an integral pressure-indicating device to readily determine the relative pressure of the ball.

7 Claims, 6 Drawing Sheets

SPORT BALL WITH SELF-CONTAINED INFLATION MECHANISM HAVING PRESSURE INDICATION

CROSS REFERENCE TO RELATED APPLICATION

This application claims the benefit of U.S. Provisional Application Ser. No. 60/404,889, filed on Aug. 21, 2002.

BACKGROUND OF THE INVENTION

The present invention relates to sport balls that contain mechanisms for inflating or adding pressure to the balls. The inflation mechanisms additionally have integral pressure indicators.

Conventional inflatable sport balls, such as basketballs, footballs, soccer balls, volleyballs and playground balls, are inflated through a traditional inflation valve using a separate inflation needle that is inserted into and through a self-sealing inflation valve. A separate pump, such as a traditional bicycle pump, is connected to the inflation needle and the ball is inflated using the pump. The inflation needle is then withdrawn from the inflation valve that self-seals to maintain the pressure. This system works fine until the sport ball needs inflation or a pressure increase and a needle and/or pump are not readily available.

In conventional sport balls, there is no easy way to determine the pressure of the ball. Some pumps have a pressure indicator on them. Alternatively, a separate pressure-indicating device may be used to determine the pressure. Surface pressure indicating devices are also well known.

SUMMARY OF THE INVENTION

The present invention provides a sport ball that has a self-contained inflation mechanism or multiple self-contained inflation mechanisms, and the inflation mechanisms have integral pressure indicating devices. The object is to be able to inflate or add pressure to a sport ball without the need for separate inflation equipment such as a separate inflation needle and pump, and to be able to determine the pressure of the ball. Specifically, the invention relates to a sport ball that has at least one self-contained pump device which is operable from outside the ball and which pumps ambient air into the ball to achieve the desired pressure. Additionally, the pump has an integral pressure indicator to determine the relative pressure of the ball.

Other objects of the invention will become apparent from the specification, drawings and claims.

BRIEF DESCRIPTION OF THE DRAWINGS

A sport ball with a self-contained inflation mechanism having pressure indication embodying the features of the present invention is depicted in the accompanying drawings which form a portion of this disclosure and wherein:

In FIG. 1A, the piston is pushed down (position 1). In FIG. 1B, the piston is pulled up (position 2);

DESCRIPTION OF THE PREFERRED EMBODIMENTS

Figure 1A:
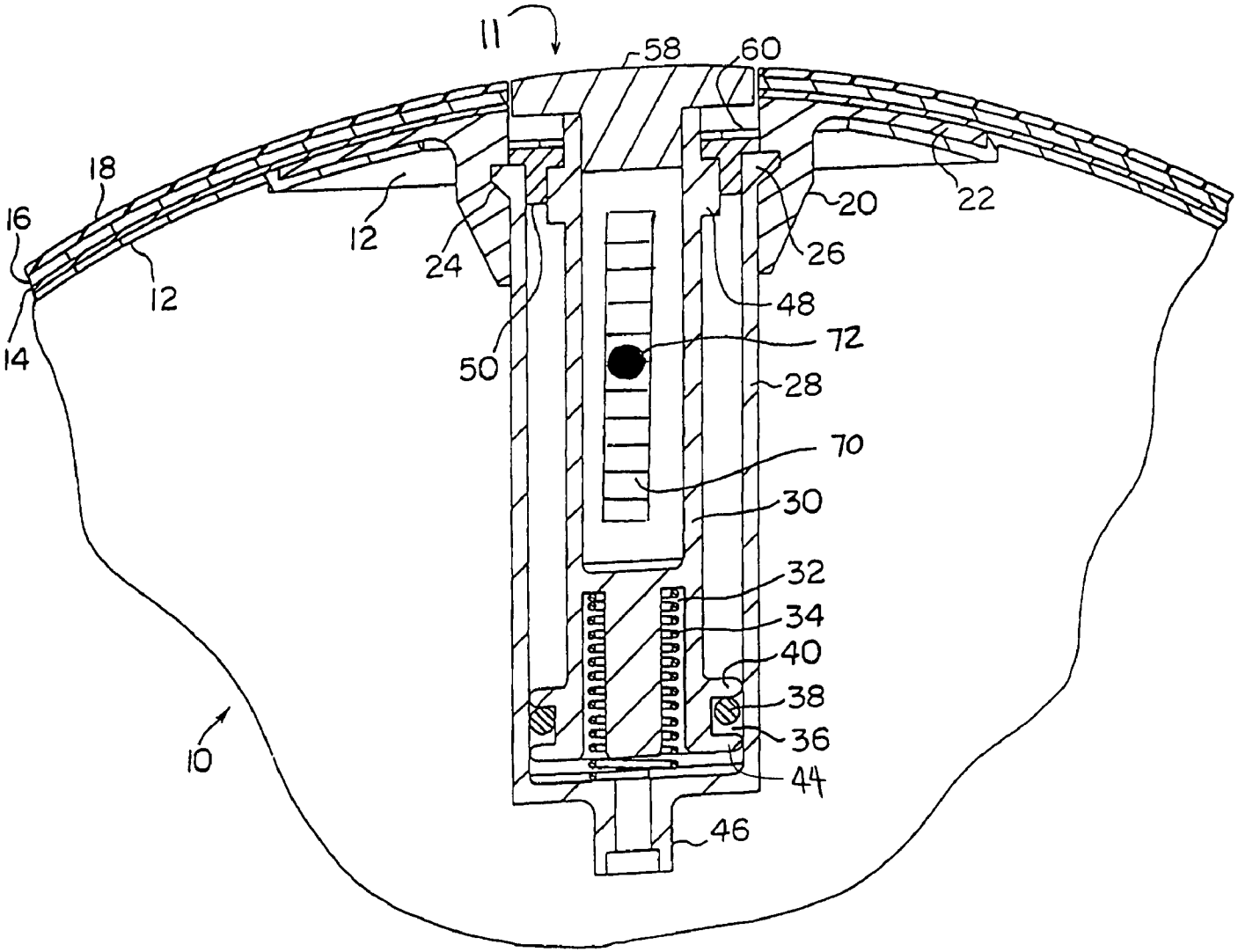
FIGS. 1A and 1B show a cross section of a portion of a sport ball with a self-contained piston and cylinder arrangement with an integral pressure indicating device.

Referring to FIGS. 1A to 6 of the drawings, a portion of a sport ball 10 is illustrated incorporating an inflation pump of the invention. The ball 10 illustrated in these figures is a typical basketball construction comprising a carcass having a rubber bladder 12 for air retention, a middle layer 14 composed of layers of nylon or polyester yarn windings wrapped around the bladder and an outer rubber layer 16. For a laminated ball, an additional outer layer 18 of leather or a synthetic material comprises panels that are applied by adhesive and set by cold molding. The windings of the middle layer 14 are randomly oriented and two or three layers thick, and they form a layer that cannot be extended to any significant degree and that also restricts the ball 10 from expanding to any significant extent above its regulation size when inflated above its normal playing pressure. This layer 14 for footballs, volleyballs and soccer balls is referred to as a lining layer and is usually composed of cotton or polyester cloth that is impregnated with a flexible binder resin such as vinyl or latex rubber. The outer layer 18 may be stitched for some sport balls 10, such as a soccer ball or a volleyball. The outer layer 18 may optionally have a foam layer backing 16 or a separate foam layer.

Other sport ball constructions, such as sport balls produced by a molding process, such as blow molding, may also be used in the invention. For an example of a process for molding sport balls, see, for example, U.S. Pat. No. 6,261,400, incorporated herein by reference.

Materials suitable for use as the bladder 12 include, but are not limited to, butyl, latex, urethane, and other rubber materials generally known in the art. Examples of materials suitable for the winding layer include, but are not limited to, nylon, polyester and the like. Examples of materials suitable for use as the outer layer 18, or cover, include, but are not limited to, polyurethanes, including thermoplastic polyurethanes; polyvinylchloride (PVC); leather; synthetic leather; and composite leather. Materials suitable for use as the optional foam layer include, but are not limited to, neoprene, SBR, TPE, EVA, or any foam capable of high or low energy absorption. Examples of commercially available high or low energy absorbing foams include the CONFOR™ open-celled polyurethane foams available from Aearo EAR Specialty Composites, Inc., and NEOPRENE™ (polychloroprene) foams available from Dupont Dow Elastomers.

Incorporated into the carcass of the ball 10 of the invention during the formation is the rubber pump boot or housing 20 with a central opening 21 and with a flange 22 which is bonded to the bladder 12 using a rubber adhesive. The boot 20 is located between the rubber bladder 12 and the layer of windings 14. The boot 20 may be constructed of any suitable material, such as butyl rubber, natural rubber, urethane rubber, or any suitable elastomer or rubber material known in the art, or combinations thereof. A molding plug (not illustrated) is inserted into the boot opening during the molding and winding process to maintain the proper shape central opening and to allow the bladder to be inflated during the manufacturing process. The molding plug is preferably aluminum, composite or rubber, most preferably aluminum. The central opening 21 through the boot 20 is configured with a groove 24 to engage a pump cylinder 28, and more specifically to hold a flange 26 on the upper end of the pump cylinder 28. The pump cylinder 28 can optionally be bonded to the boot 20 using any suitable flexible adhesive (epoxy, urethane, cyanoacrylate, or any other flexible adhesive known in the art). The pump cylinder 28 shown is a right cylinder, but other cylinders that are not right cylinders, such as a cylinder having a non-circular cross-section, may be used.

Figure 1B:
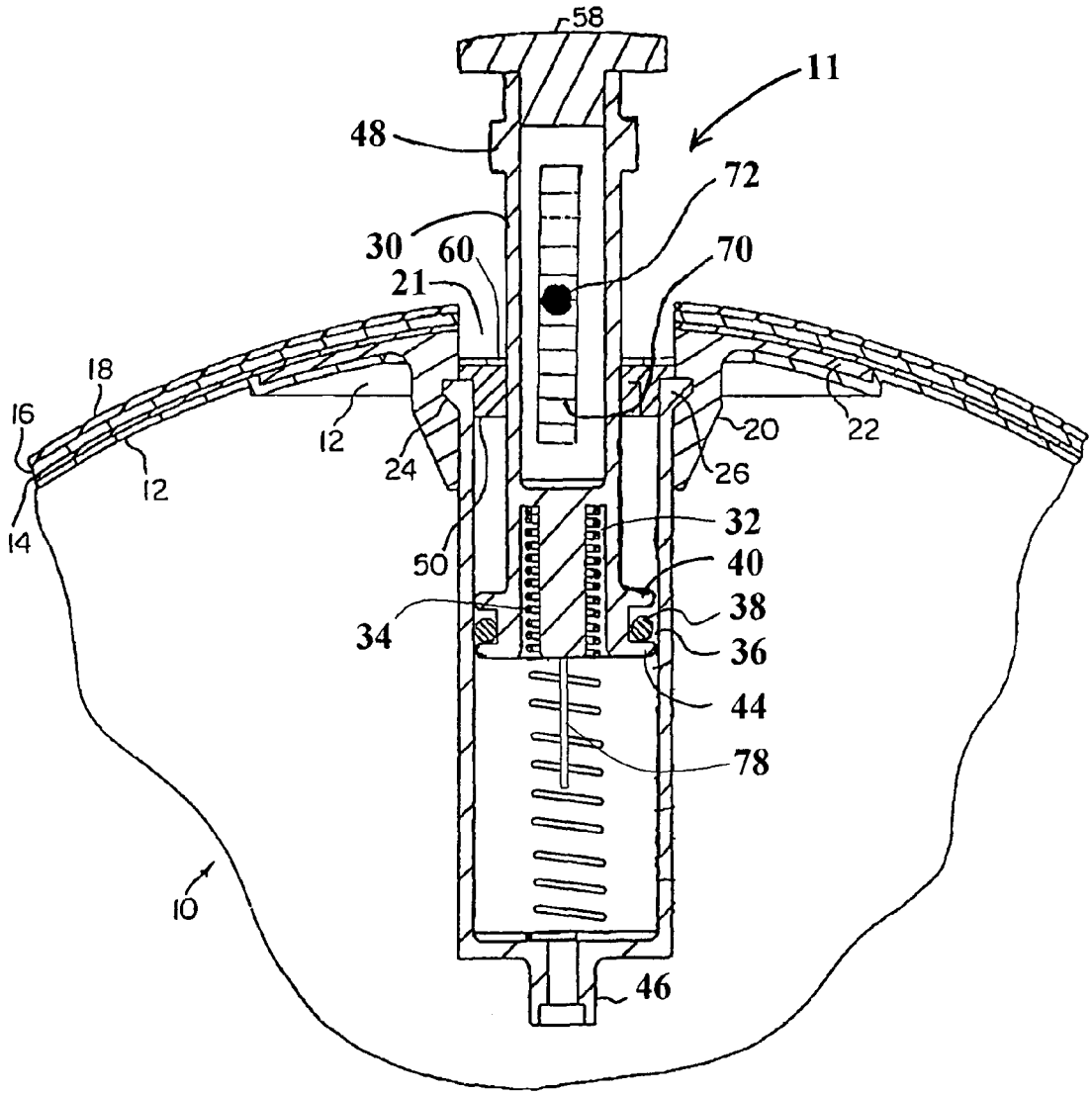

Located in the pump cylinder 28 is the pump piston 30 that is illustrated in FIGS. 1A and 1B. The pump piston 30 may include a circular groove 32 at the bottom of the piston 30 housing a spring 34, with the spring 34 forcing the piston 30 in the cylinder 28 toward the outer layer 18 of the ball 10. However, in one embodiment of the pump 11 described below, the spring 34 is not necessary to force the pump piston 30 up in the pump cylinder 28.

Figure 2:
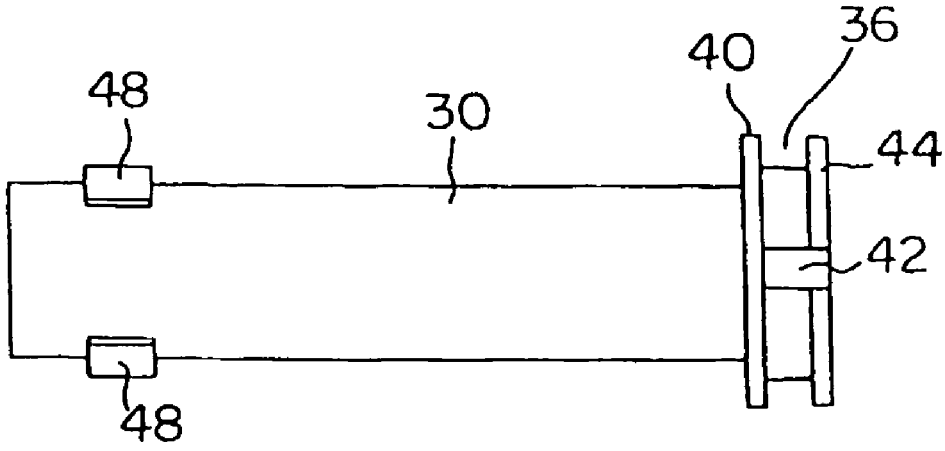
FIG. 2 is a side view of the piston shown in FIGS. 1A and 1B.

Also at the bottom end of the piston 30 is an O-ring groove 36 containing the O-ring 38. As seen in FIG. 1A, this O-ring groove 36 is dimensioned such that the O-ring 38 can move up and down in the groove 36. The O-ring 38 is forced into the position shown in FIG. 1A when the piston 30 is pushed down. In this position, the O-ring 38 seals between the cylinder wall and the upper flange 40 of the groove 36. As shown in FIG. 2, there are recesses or slots 42 in the groove 36 extending from just below the upper flange 40 down through the lower flange 44. Only one of these slots 42 is shown in FIG. 2 but there are preferably two or more. When the piston 30 is forced up by the spring 34, the O-ring 38 moves to the bottom of the groove 36 which opens up a by-pass around the O-ring 38 through the recesses 42 so that the air can enter the cylinder 28 below the pump piston 30. Then, when the pump piston 30 is pushed down, the O-ring 38 moves back up to the top of the groove 36 and seals to force the air out through the cylinder exit nozzle 46.

Figure 3:
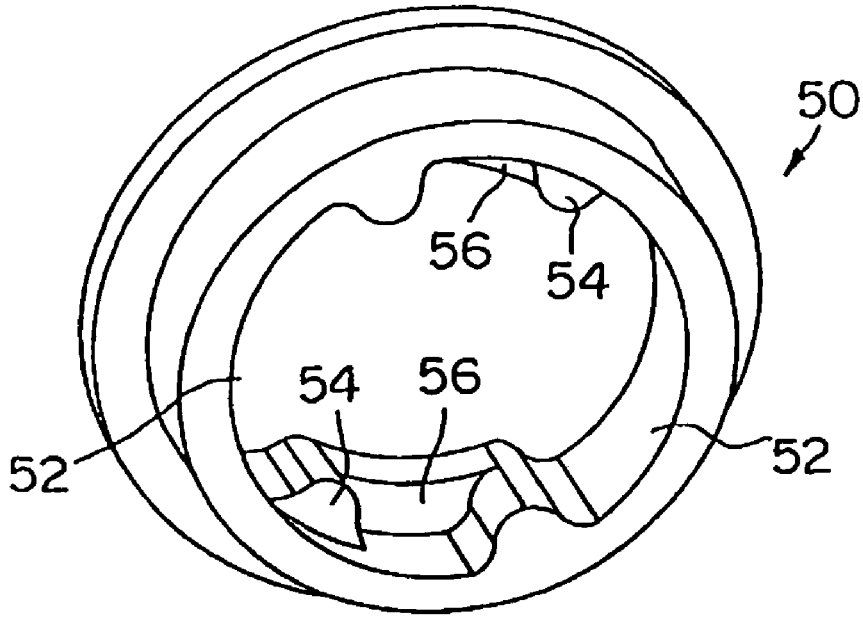
FIG. 3 is an isometric view of the cap for the pump of FIGS. 1A and 1B showing the configuration for locking and unlocking the pump piston.

At the upper end of the piston 30 are the two flanges 48 that cooperate with the cylinder cap 50 to hold the piston down in the cylinder 28 and to release the pump piston 30 for pumping. The cylinder cap 50 is fixed into the top of the cylinder 28 and the piston 30 extends through the center of the cylinder cap 50. The cap 50 is cemented into the cylinder 28 using a suitable adhesive, such as a UV cured adhesive. FIG. 3 shows an isometric view of the bottom of the cylinder cap 50 and illustrates the open areas 52 on opposite sides of the central opening through which the two flanges 48 on the piston 30 can pass in the unlocked position. In the locked position, the piston 30 is pushed down and rotated such that the two flanges 48 pass under the projections 54 and are rotated into the locking recesses 56.

Attached to the upper end of the piston 30 is a button or cap 58 that is designed to essentially completely fill the hole 21 in the carcass. In some embodiments, such as a basketball or football, the button or cap 58 is preferably flush or essentially flush with the surface of the ball 10. In other embodiments, such as a soccer ball, the button or cap 58 is preferably below the surface. This button 58 may be of any desired material. Examples of materials suitable for use as the button or cap 58 include urethane rubber, butyl rubber, natural rubber or any other material known in the art. A preferred rubber for use as the button or cap is a thermoplastic vulcanizate such as SANTOPRENE™ rubber, available from Advanced Elastomer Systems, Akron Ohio. The button or cap 58 should match the feel of the rest of the ball 10. Its surface may be textured to increase grip if desired, such as for a basketball. For a soccer ball, the surface may be smooth.

In a preferred embodiment, fibers or other reinforcing materials may be incorporated into the rubber compound or thermoplastic material during mixing. Examples of fibers materials suitable for use include, but are not limited to, polyester, polyamide, polypropylene, Kevlar, cellulistic, glass and combinations thereof. Incorporation of fibers or other reinforcing materials into the button or cap 58 improves the durability of the button 58 and improves the union of the button or cap 58 and the piston rod 30, thus preventing the button or cap 58 from shearing off during use. Although the pump would still function without the button 58, it becomes very difficult to use.

Preferably, the button or cap 58 is co-injected with the piston 30 as one part. Alternatively, the button or cap 58 may be co-injected with a connecting piece, and the button or cap 58 and connecting piece may then be attached to the upper end of the piston 30 using an adhesive suitable for bonding the two pieces together. Co-injecting the button 58 and the piston 30 as one part, or alternatively, the button 58 and the connecting piece as one part that is mounted to the piston, provides a more durable part that is less likely to break or come apart during routine use of the ball. The button or cap material and the piston material need to be selected such that the two materials will adhere when co-injected. Testing of various combinations has shown that co-injecting or extruding a soft rubber button, such as a button comprising SANTOPRENE™, and a harder piston, such as polycarbonate or polypropylene and the like, provides a durable bond without the need for adhesives.

The piston 30 and the connecting piece may be formed of any suitable material, such as, but not limited to, polycarbonate (PC), polystyrene (PS), acrylic (PMMA), acrylonitrile-styrene acrylate (ASA), polyethylene terephthalate (PET), acrylonitrile-butadiene styrene (ABS) copolymer, ABS/PC blends, polypropylene (preferably high impact polypropylene), polyphenylene oxide, nylon, combinations thereof, or any suitable material known in the art. Materials with high impact strength are preferred. The material used for the piston 30 is preferably substantially clear or transparent to allow the pressure indicating device 72 to be viewed by the user, although a translucent material may be incorporated as well.

Looking to FIG. 1A, a pad 60 is mounted on the upper surface of the cylinder cap 50. The pad 60 is engaged by the button 58 when the piston 30 is pushed down against the spring force to lock or unlock the piston 30. The pad 60 provides cushioning to the pump and should also be flexible to match the feel of the rest of the ball.

Figure 4:
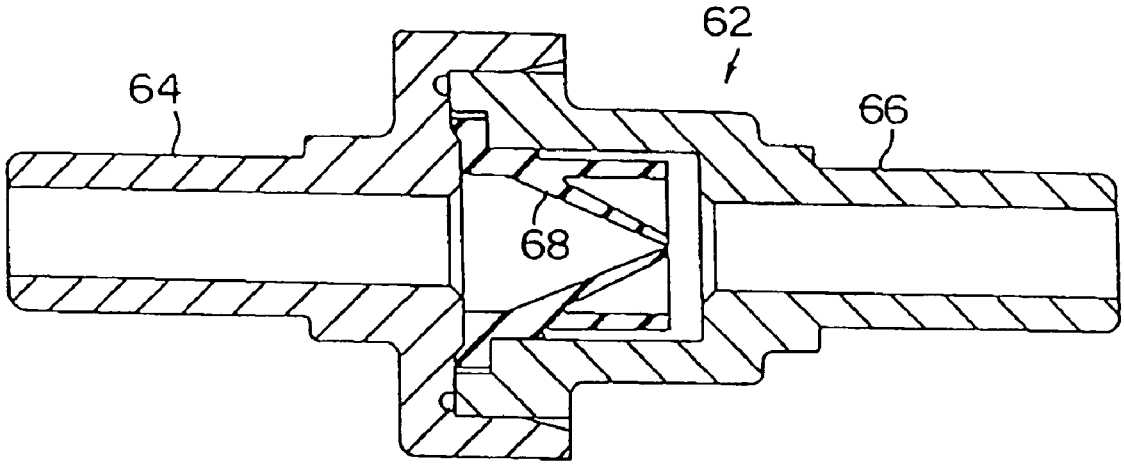
FIG. 4 is a detailed cross-section view of a one-way valve assembly for use on the exit of the pump of FIGS. 1 and 1B.

FIGS. 1A and 1B of the drawings shows a pump exit nozzle 46 but does not show the one way valve that is attached to this exit. Shown in FIG. 4 is one preferred embodiment of a one-way valve assembly 62 of the duckbill-type to be mounted in the exit nozzle 46. This assembly comprises an inlet end piece 64, an outlet end piece 66 and an elastomeric duckbill valve 68 captured between the two end pieces 64, 66. The end pieces 64, 66 are preferably plastic, such as a polycarbonate, polypropylene, nylon, polyethylene, or combinations thereof, but may be any material suitable for use. The end pieces 64, 66 may be ultrasonically welded together. Any type of one-way valve known in the art may be used, as long as it prevents air from flowing out of the interior of the ball 10 when not desired.

A pump assembly 11 of the type described and illustrated in FIGS. 1A to 6 is preferably made primarily from plastics such as polystyrene, polyethylene, nylon, polycarbonate and combinations thereof, but it can be made of any appropriate material known in the art. Although the assembly is small and light weight, perhaps only about 5 to about 25 grams, a weight may optionally be added to the ball structure to counterbalance the weight of the pump mechanism 11. In lighter weight or smaller balls, such as a soccer ball, the pump assembly 11 may weigh less and/or be smaller (shorter) than a corresponding pump assembly for a heavier ball, such as a basketball.

Figure 5:
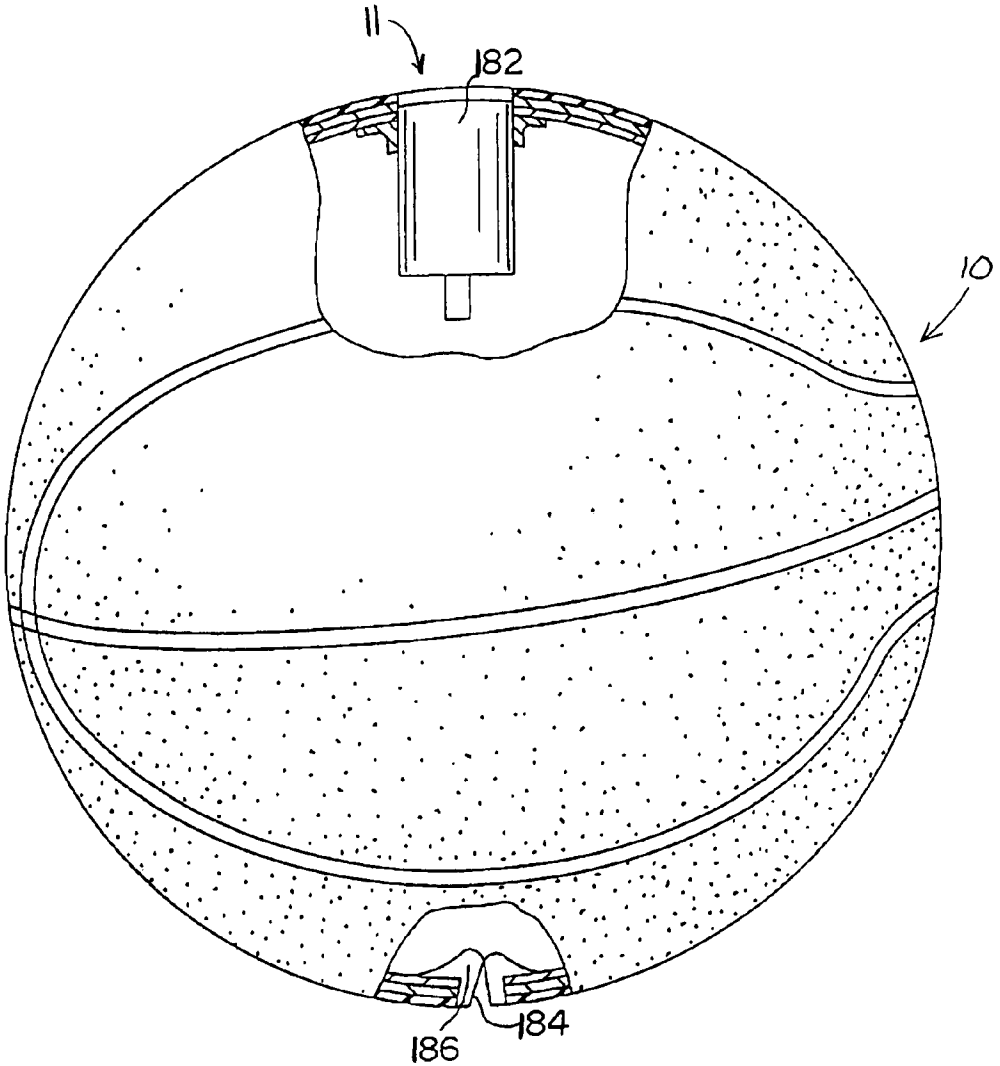
FIG. 5 is a cross-section view of an entire sport ball illustrating a pump on one side and a traditional inflation valve on the opposite side including a counterweight.

FIG. 5 illustrates such a counterbalance arrangement wherein a pump mechanism generally designated 82 is on one side of the ball and a standard needle valve 84 is on the opposite side of the ball. In this case, the material 86 forming the needle valve 84 is weighted. Additional material can be added to the needle valve housing or the region surrounding the valve. Alternatively, a dense metal powder such as tungsten could be added to the rubber compound.

Figure 6:
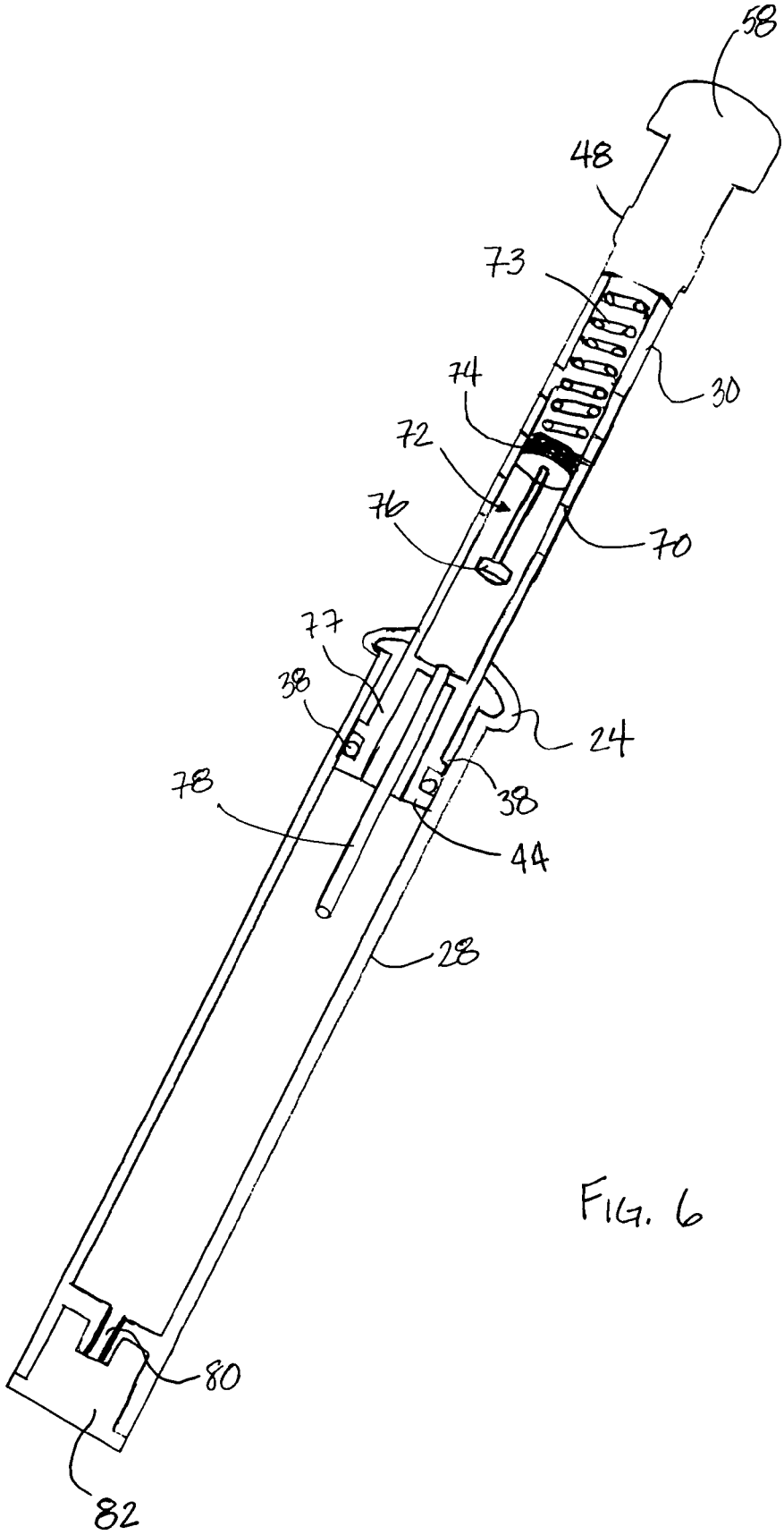
FIG. 6 is a sectional view of the pump assembly of the present invention having a pressure indicating device.

Looking further to FIG. 6, the piston 30 may be fashioned to have a hollow shaft made of a substantially clear or translucent polycarbonate material, such that the piston 30 is able to house a pressure indicating device 72. A series of pressure indication lines 70 are further marked on the piston 30 such that the position of the pressure indicating device 72 will allow the user to determine the air pressure within the game ball 10. The pressure indicating device 72 of the present invention may take various forms, such as a ball or a slide. In the embodiment illustrated in FIG. 6, the pressure indicating device 72 includes a gage puck 76 that is attached to a gage piston 74. A gage spring 73 is further positioned within the piston 30 between the gage piston 74 and the button 58. The gage spring 73 is calibrated such that it will apply a predetermined resistance against the gage piston 74. The piston 30 further includes a shaft end piece 77 holds the O-ring 38 and further serves to hold a tube or needle 78 extending from the hollow piston 30 to the area enclosed by the cylinder 28. At the end of the cylinder 28 opposite the piston 30 is a pierced rubber check valve 82, which is identical to check-valves that are used in a conventional sport balls such as basketballs.

The piston 30 illustrated in FIG. 6 operates as described above to pump air into the game ball 10. Additionally, the piston 30 of the present invention allows the user to check the air pressure within the sport ball 10 by simply depressing the button 58 into the sport ball 10. In particular, the force of the button 58 will drive the piston 30 through the cylinder 28 toward the rubber check valve 82. As the shaft end piece 77 moves toward the rubber check valve 82, the needle 78 will traverse a centering guide 80 and engage the rubber check valve 82. The needle 78 will pass through the check valve 82 to engage the center area of the sports ball 10, thereby providing a conduit for the air within the ball 10 to escape into the piston 30. The force of the air exiting the ball 10 will drive the gage piston 74 against the calibrated spring 73, and the gage puck 76 will concomitantly move toward the button 58. Consequently, the gage puck 76 will move proximate the pressure indication lines 70, which are calibrated to accurately indicate the pressure of the air within the ball 10. The air pressure will additionally operate to push the piston 30 from the cylinder 28 and toward the outer layer 18 of the ball 10, thereby assisting the user in sliding the piston 30 past the outer layer 18. The user will then be able to monitor air pressure within the ball 10 by viewing the gage puck 76 through the substantially transparent or translucent piston 30. It should also be noted that the best measurement is provided when the length of the piston 30 is in a substantially horizontal position.

Once the user has read the measurement, the piston 30 may be reinserted and locked in the cylinder 28 as described above. The gage spring 73 will further apply pressure to the gage piston 74 to return the gage piston 74 to a resting position.

It should further be noted that in the position shown in FIG. 1A, air is allowed to escape the ball 10 and show the pressure by positioning the pressure indicating device 72 in a relative position that corresponds to pressure indication lines 70. One way of achieving this is to allow the one-way valve 66 to be opened by the needle 78 of the pump 11. This allows air to escape from the interior of the ball 10 and actuate or move the pressure indication device 72 in the pump piston 30 due to air flowing through it and exiting the ball 10. In the position shown in FIG. 1B, the user will be able to view the corresponding air pressure and then force air into the ball 10 as the piston 30 is driven back into the cylinder 28.

The description thus far and the drawing FIGS. 1A to 6 disclose a particular and one preferred pump arrangement. However, other pump arrangements can be used within the scope of the invention. Examples of other pump arrangements that may be used with the invention are shown in co-pending application Ser. No. 09/594,980, filed Jun. 15, 2000; Ser. No. 09/594,547, filed Jun. 14, 2000; Ser. No. 09/594,180, filed Jun. 14, 2000; and Ser. No. 09/560,768, filed Apr. 28, 2000, incorporated herein by reference.

Since the pressure in a sport ball 10 can be too high through over-inflation or a temperature increase, or too low through under-inflation or air loss, it is an advantage to have a pressure-indicating device that is integral to the pump 11. If the pressure is too low, additional air may be added using the self-contained pump 11 of the invention. If the pressure is too high, the pressure may be relieved by bleeding pressure from the ball 10 with the conventional inflating needle (not illustrated) or other implement that will open the conventional inflation valve to release air. The pressure-indicating device 72 of the present invention may then be used to determine if the ball 10 is correctly inflated. If too much air is removed, additional air may be added using the pump 11.

The foregoing description is, at present, considered to be the preferred embodiments of the SPORT BALL WITH A SELF-CONTAINED INFLATION MECHANISM HAVING PRESSURE INDICATION. However, it is contemplated that various changes and modifications apparent to those skilled in the art may be made without departing from the present invention. Therefore, the foregoing description is intended to cover all such changes and modifications encompassed within the spirit and scope of the present invention, including all equivalent aspects.

What is claimed is:

1. An inflatable sport ball having an internal air pressure, said ball comprising:

an internal pump attached to the ball, said pump including:

a cylinder having an air outlet into the ball, a valve attached to said air outlet regulating air flow from said cylinder into the ball, a hollow piston positioned in said cylinder, said piston operable to draw ambient air from outside the ball into said cylinder and to force the air within said cylinder through said valve into the ball;

an air pressure indicator positioned within said piston;

a needle extending from said piston toward said valve, said needle traversing said valve to connect said piston with the air pressure of the ball to position said air pressure indicator.

2. The sport ball as described in claim 1 further comprising:

means for actuating said piston from outside the ball, wherein said means for actuating said piston comprise a piston rod attached to said piston and extending trough an opening in the ball and movable between an extended position and an inserted position.

3. The sport ball described in claim 1 further comprising:

a recess in said piston;

a pair of flanges surrounding said piston proximate said recess; and an adjustable O-ring intermediate said flanges and engaging said recess.

4. The sport ball described in claim 1, wherein said air pressure indicator comprises a gage piston and a gage puck connected to said gage piston.

5. The sport ball as described in claim 1 wherein said piston comprises a substantially clear polycarbonate material.

6. The sport ball as described in claim 1 wherein said piston comprises a translucent polycarbonate material.

7. The sport ball as described in claim 1 further comprising at least one pressure indicating line marked on said piston.

* * * * *